United States Patent [19]

Kovar et al.

[11] 4,252,043

[45] Feb. 24, 1981

[54] CUTTING PRESS

[75] Inventors: Josef Kovar; Lumir Zabka; Tomas Cap, all of Prague, Czechoslovakia

[73] Assignee: Statni banka ceskoslovenska, Prague, Czechoslovakia

[21] Appl. No.: 934,695

[22] Filed: Aug. 18, 1978

[30] Foreign Application Priority Data

Aug. 18, 1977 [CS] Czechoslovakia ..... 5440-77

[51] Int. Cl.[3] ..... B26F 1/14

[52] U.S. Cl. ..... 83/417; 83/278; 83/281; 83/420; 83/620; 83/859

[58] Field of Search ..... 83/278, 449, 620, 687, 83/691, 423, 29, 859, 281, 276, 277, 635, 417, 420

[56] References Cited

U.S. PATENT DOCUMENTS

| | | | |
|---|---|---|---|
| 378,805 | 2/1888 | Richards | 83/277 X |
| 1,229,057 | 6/1917 | Fritch | 234/130 |
| 2,127,651 | 8/1938 | Panther | 83/687 X |
| 3,045,518 | 7/1962 | Kjelgaard | 83/691 X |
| 3,187,613 | 6/1965 | Behling | 83/278 X |
| 3,215,014 | 11/1965 | Malamood et al. | 83/278 X |
| 3,266,352 | 8/1966 | Kuts | 83/622 X |
| 3,698,232 | 10/1972 | Vinson | 83/687 X |
| 3,731,571 | 5/1973 | Larson | 83/449 X |
| 3,785,194 | 1/1974 | Bradlee | 83/620 X |
| 3,788,030 | 1/1974 | Moline | 83/620 X |
| 3,797,342 | 3/1974 | Sekel | 83/691 X |

*Primary Examiner*—J. M. Meister

[57] ABSTRACT

There is disclosed a cutting press adapted for the cutting of paper, such as discarded paper money. The cutting device is mounted in a support having the shape of a case with open side walls, a feeding conveyor passing through the case forwarding the paper to be cut to the press.

6 Claims, 3 Drawing Figures

CUTTING PRESS

BACKGROUND OF THE INVENTION

The invention relates to a cutting press, adapted particularly for the cutting of discarded paper money.

Known cutting presses have the cutting device arranged so that the bottom dies are situated in a supporting base plate and the feeding of worked objects to the press and their removal therefrom is accomplished manually.

A correct operation of the cutting press requires a base or die plate which cannot be distorted. It must be therefore rigid and consequently rather thick. It is thus of large dimensions and heavy. Despite this, the punches become frequently off-center and the lifetime of the cutting press is rather low.

The manual feeding and removal of worked objects is slow, and the safety of the working conditions is not always fully guaranteed.

SUMMARY OF THE INVENTION

It is an object of this invention to provide a cutting press which is sufficiently rigid, insures a correct alignment of the punches and the bottom dies, and is of reasonable weight. It is another object of this invention to provide an automatic feeding of objects to be cut, and thus to improve safety of the attendant.

The cutting press according to this invention has a cutting device situated in a support of the shape of a case supported in a frame and provided with guiding means for punches and with a throughgoing automatic conveyor.

The case-shaped support according to this invention secures the coaxiality of the die openings of the bottom die with the punch tools and is of smaller dimensions and of less weight than actually known arrangements of this kind. In addition, it enables the use of an advantageous situation of an automatic conveyor, which substantially increases the output of the cutting press and the safety thereof in use.

The objects to be cut are taken over by the conveyor, for instance from a storage stack or from another conveyor, and are continuously supplied to the cutting part of the press. After punching or cutting, the cut objects are continuously removed by the same conveyor and are supplied, for instance, to a container or to another conveyor or the like. Both operations are performed quite automatically, without any manual attention.

The cutting press according to this invention can be easily adjusted and is capable of working upon objects of different dimensions. The respective adjustments can be accomplished directly on the control panel of the press or from a central control panel of a manufacturing line.

DESCRIPTION OF DRAWINGS

Exemplary embodiments of presses according to this invention is illustrated in the attached drawings, wherein.

DESCRIPTION OF PREFERRED EMBODIMENT

The cutting device is mounted in a support in the shape of a box or case 1 supported in a frame 2.

Figure 1:
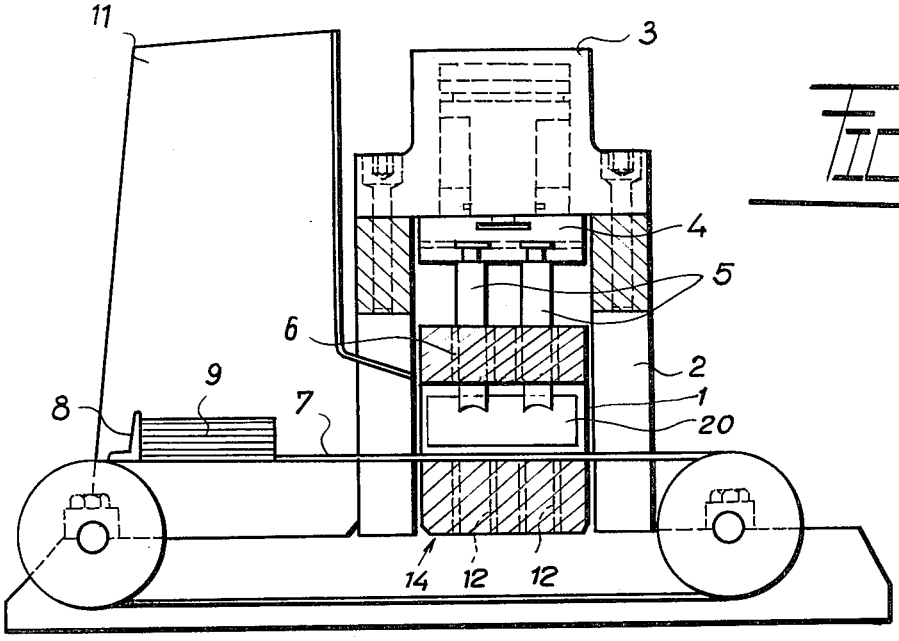
FIG. 1 is a side view of the cutting press; certain of the parts being shown in vertical section the guiding elements for the worked object being omitted.
Figure 2:
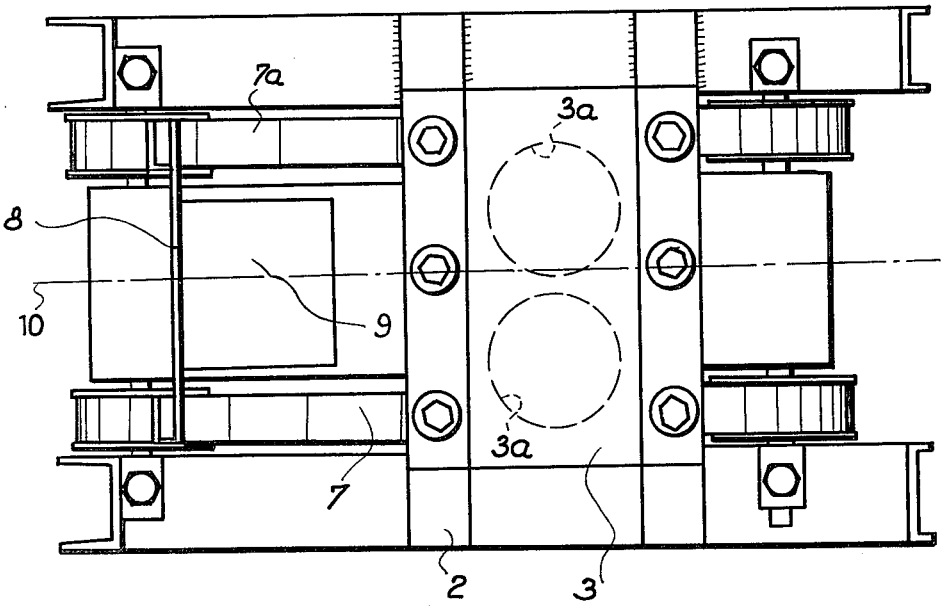
FIG. 2 is a top view of the cutting press; of FIG. 1.
Figure 3:
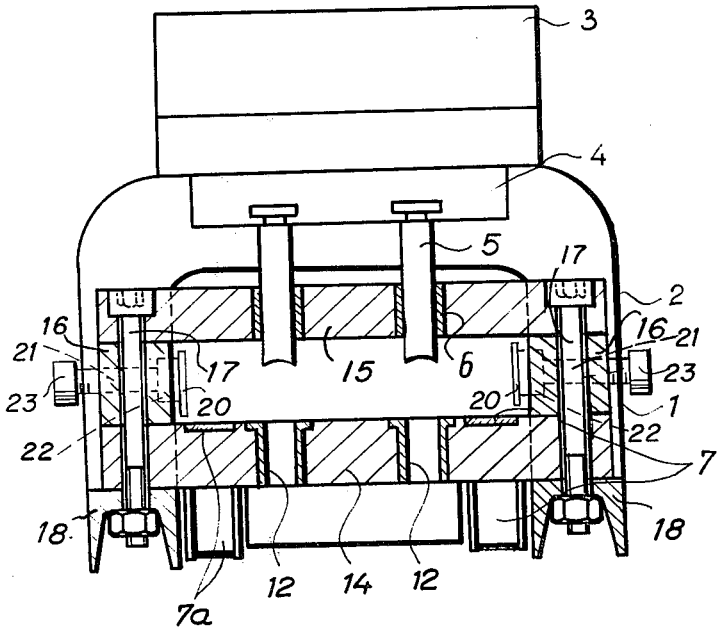
FIG. 3 is an end view of the apparatus of FIG. 1 in the direction of the axis of the feeding conveyor toward the cutting device, the cutting device being shown in vertical section.

As shown in FIG. 3, frame 2 has an upper arched part and lower parallel horizontal longitudinal members 18 connected thereto. The box or case 1, which is of open rectangular shape, has a horizontal lower member 14, a horizontal upper member 15 parallel to member 14, and two spaced vertical members 16 interposed between the opposite ends of members 14 and 15. Members 14 and 15, as well as members 16, are secured together to form a unitary structure by tie bolts 17, which also connect frame 2 to the lower horizontal members 18 of frame 1.

A pressing unit 3 in the form of two hydraulic cylinder and piston combinations **3*a* is situated in the upper, arched part of the frame 2, the piston rods acting by way of a press plate 4 on punches 5. Punches 5 are guided in guide sleeves 6 supported in the upper member 15 of the case 1, and at the bottom of their stroke enter at least the upper ends of openings 12 forming female dies in member 14 which functions as a base or press plate. A feeding conveyor made up of parallel synchronously driven belts 7, 7*a* passes through the cutting device and supplies, by means of one or more rakes 8 connected at their opposite ends to the belts, 7, 7*a*, the worked objects to the press. In the case given, the worked objects are packages of discarded paper money, stored in a storage stack 11. The adjustment of the object 9 in direction of the longitudinal axis 10 of the conveyor 7, 7*a*** is accomplished by a predetermined advance of the conveyor by steps, obtained, for instance, by a stepping motor (not shown) which drives the conveyor, or by a motor with a selectively engageable and disengageable coupling (not shown).

The adjustment of the worked object 9 in the transverse direction can be accomplished by guiding elements 20, the adjustment of which is, for instance, derived from one or more threaded screws 21 connected to the guides 20 by swivel joints 22. When screws 21 are turned in opposite directions by knobs 23, they move the guiding elements through equal distances from the center line of the press toward and away from each other. It is also possible to derive such transverse adjustment of the guiding elements from a manually operated cam disc (not shown). The hydraulic power unit 3 is connected to a classical hydraulic circuit with a hydraulic storage unit.

The control and synchronization of working steps of the cutting press as arranged according to this invention can be accomplished by electrical coupling with a relay unit, by an electronic control unit, or by a mechanical program unit.

The picking-up of limit working positions as, for instance, of positions of pistons, of corresponding positions of punches, of positions of the rake or rakes and guiding elements can be accomplished, for instance, by opto-electric elements, by magnetic relays, by limit switches and the like.

The whole unit is compact, the individual elements can be easily dismantled; this facilitates the maintenance of the cutting press. The whole press is of substantially lower weight and dimensions than cutting presses of known design. The safety of working conditions is fully secured.

The installation of the whole arrangement in a mechanized manufacturing line is rather simple, either by means of conveyors or by the use of a conveyor which passes through the whole manufacturing line including the press.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A cutting press adapted for the cutting of worked objects such as discarded paper money, comprising an arch-shaped main frame, a pressing unit supported by said main frame, and having a reciprocable press plate, at least one punch mounted on the press plate, a cutting device disposed within the arch of the main frame below and in alignment with the direction of the stroke of the press plate, the cutting device having an open box from with vertically spaced parallel upper and lower members and horizontally spaced side members connecting the respective ends of the upper and lower members, at least one open punch guiding sleeve in the upper member of the frame of the cutting device, the lower member of the frame of the cutting device being a die plate having at least one female die disposed at an opening therethrough with which said punch cooperates, and a feeding conveyor passing through the frame of the cutting device between the upper and lower members of the frame, the upper and lower members and side members of the open box frame of the cutting device constituting an open beam wherein the upper and lower members thereof cooperate in resisting the thrust imposed by the punch upon the female die during an object cutting operation.

2. A cutting press according to claim 1, comprising a plurality of punches, and wherein the die plate has a plurality of openings therethrough which cooperate with respective ones of the punches.

3. A cutting press according to claim 2, wherein the punches and openings in the die plate are arranged in lines disposed transversely of the direction of travel of the conveyor.

4. A cutting press according to claim 1, wherein the conveyor comprises two laterally spaced parallel belts, means for driving the belts in synchronism and in a stepwise manner, and at least one transverse rake spanning the distance between the two belts and connected at its opposite ends to respective ones of the belts.

5. A cutting press according to claim 1, comprising laterally adjustable means for guiding the worked objects laterally as they travel on the conveyor.

6. A cutting press according to claim 1, comprising means providing for support of stacked objects to be worked, said last named means being disposed upstream of the cutting press proper and providing a passage therethrough for the conveyor.

* * * * *